US005177968A

United States Patent [19]

Fellows

[11] Patent Number: 5,177,968

[45] Date of Patent: Jan. 12, 1993

[54] RADIAL HOT GAS ENGINE

[76] Inventor: Oscar L. Fellows, P.O. Box 201207, Austin, Tex. 78720

[21] Appl. No.: 885,896

[22] Filed: May 20, 1992

[51] Int. Cl.[5] ..... F02G 1/044

[52] U.S. Cl. ..... 60/525; 60/517

[58] Field of Search ..... 60/525, 517

[56] References Cited

U.S. PATENT DOCUMENTS

| | | | |
|---|---|---|---|
| 4,191,019 | 3/1980 | Bratt et al. | 60/525 |
| 4,545,205 | 10/1985 | Bras | 60/525 |
| 4,723,411 | 2/1988 | Darooka et al. | 60/525 |

FOREIGN PATENT DOCUMENTS

| | | | |
|---|---|---|---|
| 429178 | 1/1948 | Italy | 60/525 |
| 48404 | 4/1984 | U.S.S.R. | 60/525 |

*Primary Examiner*—Allen M. Ostrager

[57] ABSTRACT

A radial, hot-gas engine which derives the necessary phase angle between hot and cold cylinders by locating them ninety degrees apart around the circumference of the crankcase, thereby eliminating complicated piston connecting rod linkages and permitting use of a simple eccentric and roller-follower drive arrangement between pistons and crankshaft. The radial design permits use of the crankcase as a pressure vessel and storage reservoir for the working fluid while keeping crankcase mass low relative to conventional engine designs. The invention also eliminates critical seals by application of an integral pump that scavenges working fluid from the crankcase reservoir and pressurizes the working cylinders when the engine is started, and maintains working pressure while the engine is in operation. Check valves, relief valves and an unloader valve arrangement control pressure, and equalize the pressure across the pistons when the engine is turned off by allowing the working fluid to return to the crankcase reservoir. An internal rotor winding resides within the crankshaft eccentric, and forms half of a combination starting motor/generator and electric transmission. Crankcase sections, each with its own array of pistons, cylinders and starter/generator windings, may be ganged to increase engine displacement and power.

1 Claim, 6 Drawing Sheets

RADIAL HOT GAS ENGINE

BACKGROUND OF THE INVENTION

Stirling Cycle engines, sometimes called Hot-air engines or Hot-gas engines, are, as evidenced by more than 600 patents since its invention in the early 19th century by Reverend Robert Stirling of Edinburgh, Scotland, from whom the thermodynamic cycle gets its name, a well known genre of machine chiefly characterized by an operating process in which an internally-contained working fluid is alternately and periodically heated and cooled, via conduction, through heat-exchangers which are integral parts of the machine, by an external heat source and an external heat sink, in order to cause cyclic pressure changes within the working fluid and thereby accomplish work. These heat-exchangers are generally closed cylinders, or closed spaces of other geometry, with variable volumes. The variation in volume is accomplished by means of sliding pistons or other movable members which are usually connected to a common crankshaft, though multiple crankshafts and other mechanical arrangements also exist, which maintain a phase angle between the pistons and/or displacers. Some of these machines have a mechanical arrangement in which a compression piston and a displacer piston reside within a single cylinder, and are called co-axial machines. In others, the pistons are arranged in multiple, inter-connected cylinders, in which the pistons act upon the working fluid in both directions of stroke, and are therefore called double-acting machines. Still in other machines, sometimes referred to as Wankel or rotary engines, the working mechanism consists of multiple, tangential-displacement rotors which act upon the working fluid to effect its movement between heat-exchangers.

The common relationship between these machines is that the working cycle necessitates that the related cold-side variable volume and the hot-side variable volume be so connected that said volumes vary in a fixed phase relationship to one another, of approximately ninety degrees. By this arrangement, a working fluid within two such, connected, variable-volume spaces can be compressed or decompressed by pistons or other displacement mechanisms which are connected to a common crankshaft. When the heat exchangers are properly designed, the working fluid is increased in temperature and pressure so that it performs work upon the cold-side displacement mechanism through part of the thermodynamic cycle, then is decreased in temperature and pressure so rapidly that the cold-side displacement mechanism can be carried through the remainder of the cycle by inertial moment, without performing work upon the working fluid. In this way a net gain in work output is realized.

SUMMARY OF THE INVENTION

The preferred embodiment of the invention incorporates a multiplicity of roughly cylindrical crankcase sections, around the outer perimeter of which are distributed, in a radial arc, and even multiple number of cylinders, each of which houses a closely-fitted sliding piston. The cylinder arrangement of each crankcase section is similar to the arrangement of the spokes in a wagon wheel, with the spokes radiating outward from a central hub on a single plane, with the crankcase located at the hub of the analogous wagon wheel. Multiple planes of cylinders may be abutted together on a common crankshaft, analogous to placing multiple wagon wheels side-by-side upon a common axle, in order to increase the number of cylinders working in additive association, and thereby increasing engine power. The base of each cylinder opens into the crankcase, so that the bases of the pistons can protrude into the crankcase.

The variable-volume compression space within each cylinder is connected, via a passage for the working-fluid, to another cylinder which is ninety (90°) degrees around the perimeter of the crankcase from the first cylinder, so that each pair of cylinders which are located at ninety degrees in relation to each other, form a working pair of hot and cold cylinders. One cylinder of each pair constitutes the hot-side heat exchanger, and is fitted with a combustion burner. The other cylinder comprising each pair is a cold-side heat exchanger and is fitted with a water jacket or cooling shroud so that water, air or some other fluid may carry away a portion of the thermal energy generated in the first cylinder.

At some point within the connecting, working-fluid passage, a thermal capacitor, also known as a regenerator, is located. This device takes up and momentarily stores thermal energy from the heated working-fluid as it passes from the hot-side cylinder to the cold-side cylinder, then returns said energy to the cooled working-fluid as it is returned to the hot-side cylinder.

The pistons are comprised of cylindrical shapes sealed at the outward (from the center of the crankcase) end, which incorporate a multiplicity of sliding seals around their circumference. These seals are affixed to the pistons, and slide back and forth in engagement with the cylinder walls as the pistons reciprocate within said cylinders. The desired effect of these seals is the containment of the working fluid within the cylinders, minimizing the quantity leaking past the pistons in a unit of time.

The base of each piston terminates in a roller-follower which runs in contact with an eccentric that is affixed to a rotating crankshaft. As the eccentric rotates within the crankcase, the pistons riding in contact with it are caused to reciprocate within their respective cylinders. When the engine is in operation, the compression-space or cold-side piston of each associated pair, produces a power stroke during each revolution of the eccentric, which acts upon the eccentric to cause it to rotate, thereby transmitting rotary motion to the crankshaft to which the eccentric is affixed.

The interior of the crankshaft eccentric is hollowed out so that an electrical winding with pole pieces may be fitted inside it. This winding is a component part of a combination starting motor/electrical generator and electric transmission.

Each engine is comprised of a multiplicity of planes of cylinders, each plane affixed to a cylindrical section which constitutes a crankcase section. The planes of cylinders are joined by abutting successive crankcase sections together so that they comprise an extended, common crankcase, housing a common crankshaft. The terminus ends of the consolidated crankcase are sealed with end-plates which house bearings that support the crankshaft. The end plates also house component parts of a combination starter motor/electrical generator and electric transmission.

When the engine is configured for generating electrical power, the crankcase end plate houses the stator assembly of the generator, which fits inside the rotor winding that is affixed inside the crankshaft eccentric.

When the engine is configured to produce tractive force, as in causing an external shaft to rotate and transmit motive power to a load, the end plate houses the stator assembly of a combination alternating-current generator/motor. This stator forms a cavity sealed off from the internal workings of the engine, and open to the external engine environment. An electric, induction rotor, affixed to an output shaft, is inserted into the aforesaid cavity from the exterior of the engine, where a rotating electric field generated within the stator can be controlled to induce repulsive currents in the rotor and impart rotary motion to the rotor and shaft.

Each engine incorporates a pressure pump assembly, which is comprised of a multiplicity of cylinders and pistons disposed radially about the circumference of a crankcase, and a crankshaft which passes through the central axis of said crankcase, said crankshaft having an eccentric affixed to it, against which the aforementioned pistons ride in contact. Said crankcase and eccentric arrangment is similar in design to those comprising the engine, and the pump crankshaft and eccentric are driven by the engine crankshaft. The pump assembly incorporates a multiplicity of check valves, said check valves acting to control the flow and pressure of the working-fluid. Said check valves are comprised of a ball and seat arrangement, the ball being held against the seat by the tension of a spring. Said spring tension is overcome if the pressure of the working fluid is sufficient, and the ball thus unseated allows working fluid to flow through the valve in one direction. The force of a pressure from the opposite direction adds to the force the spring is exerting to maintain the ball in a seated position, and if the additive forces are sufficient, the ball remains seated. This arrangement creates an automatic check valve which permits fluid flow in only one direction. Such valves are very well known, and are common in fluid-handling apparatus.

The unloader valve assembly is comprised of an electric, solenoid valve which closes when current is applied to the solenoid winding. When the ignition circuit of the engine is closed, such as in preparation for starting the engine, current flows through the solenoid winding, causing said unloader valve to close, thereby closing off a working fluid return passage which connects the working cylinders of the engine to the engine crankcase. When said valve is thus closed, the pressure pump scavenges the working fluid from the crankcase and transfers it into the working cylinders, thereby elevating the pressure within the working cylinders. When the ignition circuit is opened, such as when the operation of the engine is caused to cease, current ceases to flow through the solenoid circuit, and the tension of a compressed spring returns the unloader valve to a normally open position, thus allowing the high-pressure working-fluid in the cylinders to flow into the crankcase reservoir.

Pressure regulator valves vent working fluid when pressures exceed a pre-set maximum. One pressure regulator valve limits pressure in the working cylinders, while another limits crankcase pressure.

These pressure and unloader valve assemblies regulate the starting and operating pressure of the working fluid. The purpose of said assemblies is to automatically reduce pressure within the cylinders when the engine has ceased operation, by permitting the pressure of the working fluid to equalize between the cylinders and the crankcase; then to transfer the working fluid from the crankcase to the cylinders as the engine is put into operation, increasing the working pressure within said cylinders to a predetermined, operating level, and maintaining it at said level for as long as the engine is in operation. These actions permit the engine to begin operation without the pistons having to overcome full working pressure in the cylinders.

A manual valve is also incorporated into the pressure pump circuit which permits the pump to take up working-fluid from either the crankcase or an external source. In the closed position, the valve isolates the crankcase and working-fluid path from the external environment, permitting the crankcase to act as an accumulator and storage reservoir for the working-fluid, which the pump can then evacuate, when it transfers the working fluid to the power cylinders, as the engine comes into operation. In the open position, the working-fluid path is open to the external environment, or connected to an external container or apparatus, as desired. This feature permits the engine to be evacuated or charged with working fluid.

The working fluid path which connects the pressure pump to the engine crankcase incorporates a filter and heat-exchanger. This apparatus cools the working fluid extracted from the crankcase and precipitates any lubricating oil which may be vaporized in the working fluid, returning it to the crankcase of the engine. The desired effect of said apparatus is to minimize the amount of lubricant entering the working fluid passages of the engine.

The invention will be described in detail hereinafter with reference to drawings which are not to scale.

DESCRIPTION OF THE PREFERRED EMBODIMENTS

Figure 1:
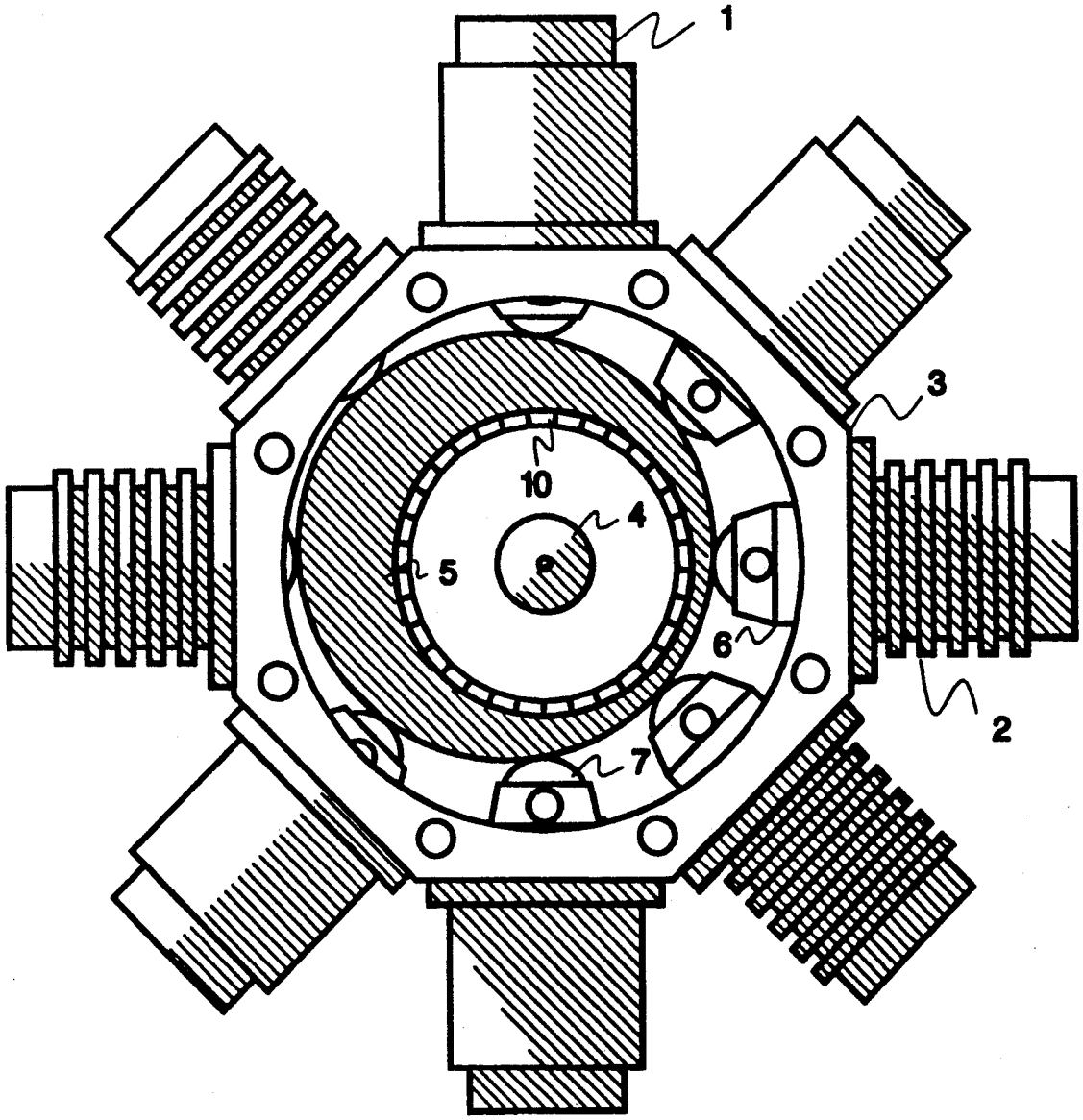
FIG. 1 is a cross-sectional view of the engine crankcase, showing the radial distribution of the power cylinders and pistons, and the inner workings comprising the eccentric and crankshaft.

With reference to FIG. 1, numeral 2 indicates a cold-side cylinder which is typical of the cold-side cylinders with the water jacket or cooling shroud removed, and which is disposed at a ninety-degree (90°) angle of crankshaft 4 rotation from its paired hot-side cylinder 1. A water jacket (not shown) shall be incorporated in liquid-cooled engines, and a cooling shroud (not shown) in gas-cooled engines. A separate combustion chamber (not shown) surrounds each hot-side cylinder, and said chamber, and attendant air intake and exhaust system, preheats incoming combustion air, injects fuel and ignites it on the surface of the hot-side head (not shown), as it channels away the hot exhaust gases. The crankcase 3 houses the crankshaft 4 and a typical driven eccentric 5. The eccentric 5 incorporates a central, hollow cavity designed to house an electrical winding with pole pieces 10 which comprise a part of a combination internal electrical generator/starting motor and electric transmission. Said winding 10 is incorporated into the eccentric 5 for the purpose of producing electrical power, and also serves as a starter-motor to start the engine when suitable current is applied to the windings from an external source. Electrical connections are typical of common electrical motors and generators, and are not shown. A typical piston 6 is shown, and roller-follower 7.

Figure 2:
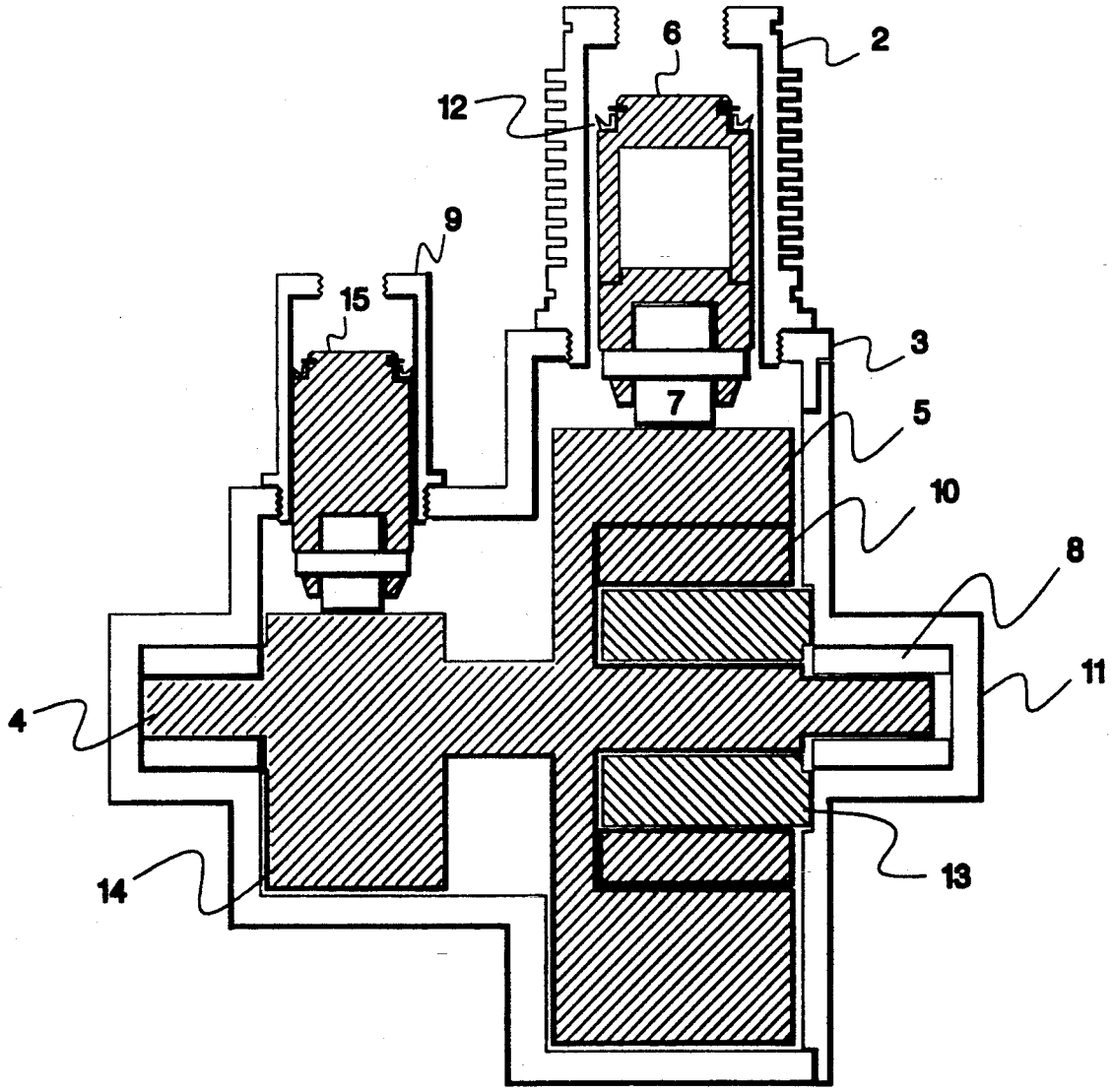
FIG. 2 is a side view showing the relationships of the pressure pump mechanism and the main crankcase and power cylinders in an assembled engine configured for electrical power generation.

With reference to FIG. 2, which is a cross-sectional view of a single-stage engine, numeral 9 indicates a typical cylinder of the pressure pump, which houses a piston 15. The internal workings of the pump are similar in design to the pistons 6, roller-followers 7, seals 12 and eccentric 5 as illustrated for the main engine, and the pump eccentric 14 is driven by the common crankshaft 4. Said crankshaft 4 is supported by multiple bearings 8. The crankcase end-plate illustrated 11 houses one of said crankshaft support bearings 8 and the motor/generator stator winding 13. Said stator winding 13 fits inside the rotor winding 10 in the eccentric 5 when the crankcase end-plate 11 is assembled to the crankcase 3, and is stationary with respect to the engine, while the rotor winding 10 is free to rotate about said stator winding 13.

Figure 3:
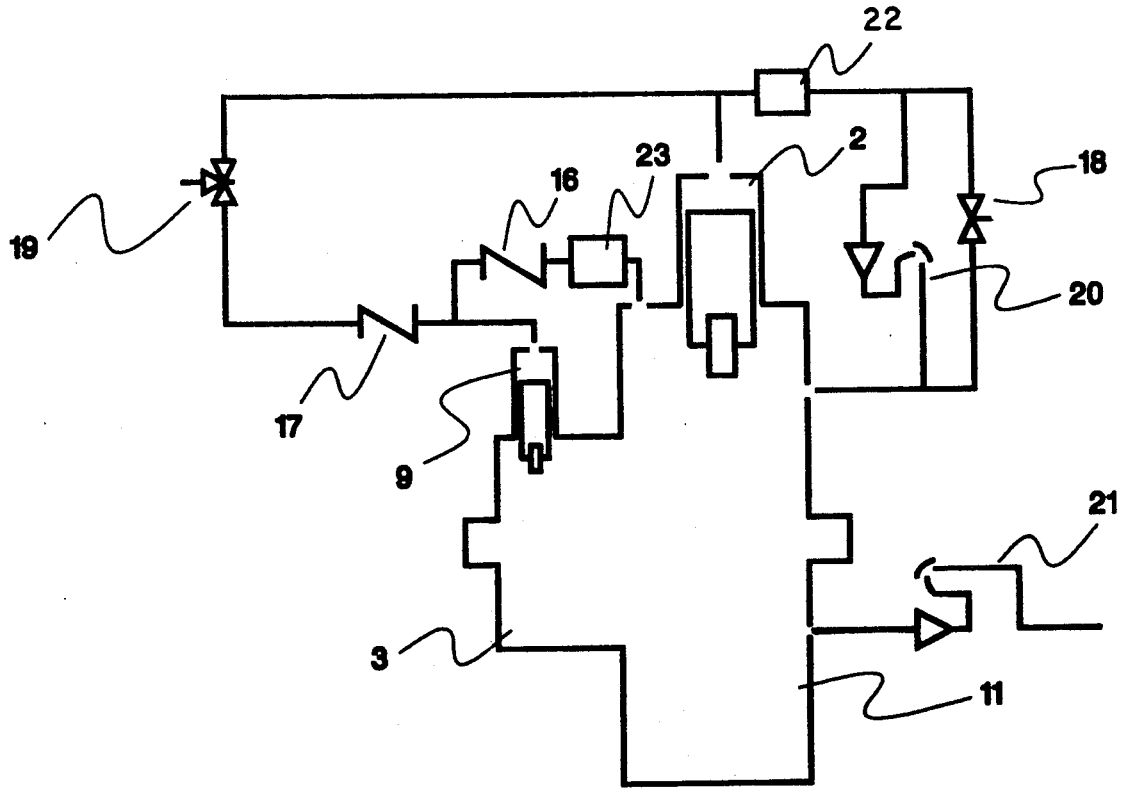
FIG. 3 is a schematic view of the pump and valve assemblies, and the fluid passages.

FIG. 3 is a schematic diagram showing the valve arrangement which controls the working fluid. The crankcase check valve 16 permits the working fluid to be drawn from the crankcase 3 and into the pump cylinder 9, but prevents the working fluid from flowing through the valve 16 in the reverse direction, into the crankcase 3. Check valve 17 permits the working fluid to pass from the pump cylinder 9 into the engine working cylinders 2, but prevents said working fluid from flowing through the valve 17 in the reverse direction, into the pump cylinder 9. The solenoid valve 18 closes when the engine is started, so that pressure can build up in the working cylinders 2, and opens when the engine ceases to operate, permitting working fluid to return to the crankcase 3. The pressure-relief valve 20 permits working fluid to bypass the solenoid valve 18 and return to the crankcase 3 whenever pressure in the working fluid exceeds a preset maximum. The pressure relief valve 21 vents working fluid from the engine crankcase when crankcase pressure exceeds a preset maximum. The cooler 22 reduces the temperature of the working fluid as said working fluid passes from the working cylinder to the crankcase reservoir. The cooler 23 precipitates vaporized lubricant and returns said lubricant to the crankcase. The two-way valve 19 permits the working fluid passages to be sealed off from the outside environment, or opened to the environment. Said valve 19 permits the engine to be charged with working fluid, and to have said working fluid and other fluids evacuated.

Figure 4:
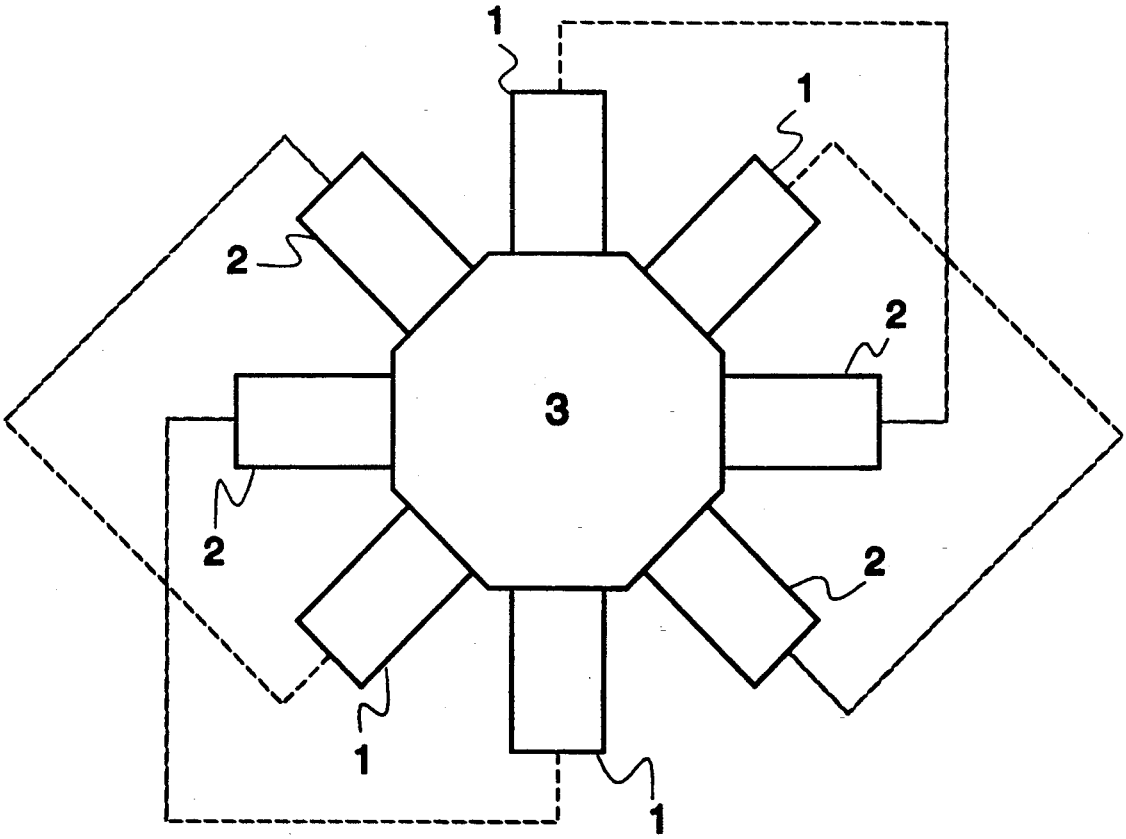
FIG. 4 is a schematic view illustrating how the cylinders are connected to obtain the proper phase-angle between working pairs.

FIG. 4 is a schematic diagram showing how the cold-side cylinders 2 and hot-side cylinders 1 are paired. Each cold-side cylinder 2 is disposed at ninety degrees (90°) of crankshaft rotation from its paired hot-side cylinder 1, thereby maintaining a ninety degree (90°) phase-angle between the strokes of the pistons in the paired cylinders.

Figure 5:
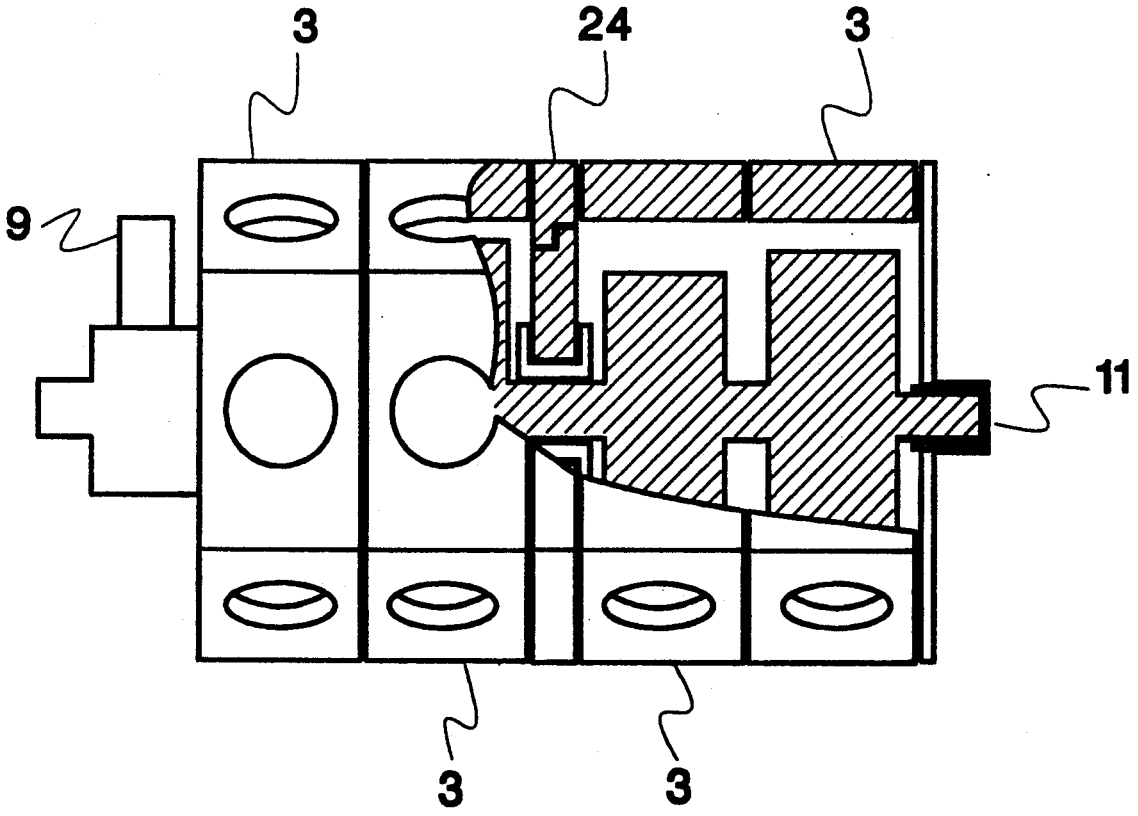
FIG. 5 is a side view illustrating how multiple crankcase sections may be ganged, and a typical intermediate bearing plate which serves to help support the extended crankshaft.

FIG. 5 is a cut-away view of a typical engine showing the pump and pump cylinder 9, assembled with multiple crankcase sections 3, an intermediate bearing plate 24 which supports the center portion of the internal crankshaft, and the crankcase endplate 11.

Figure 6:
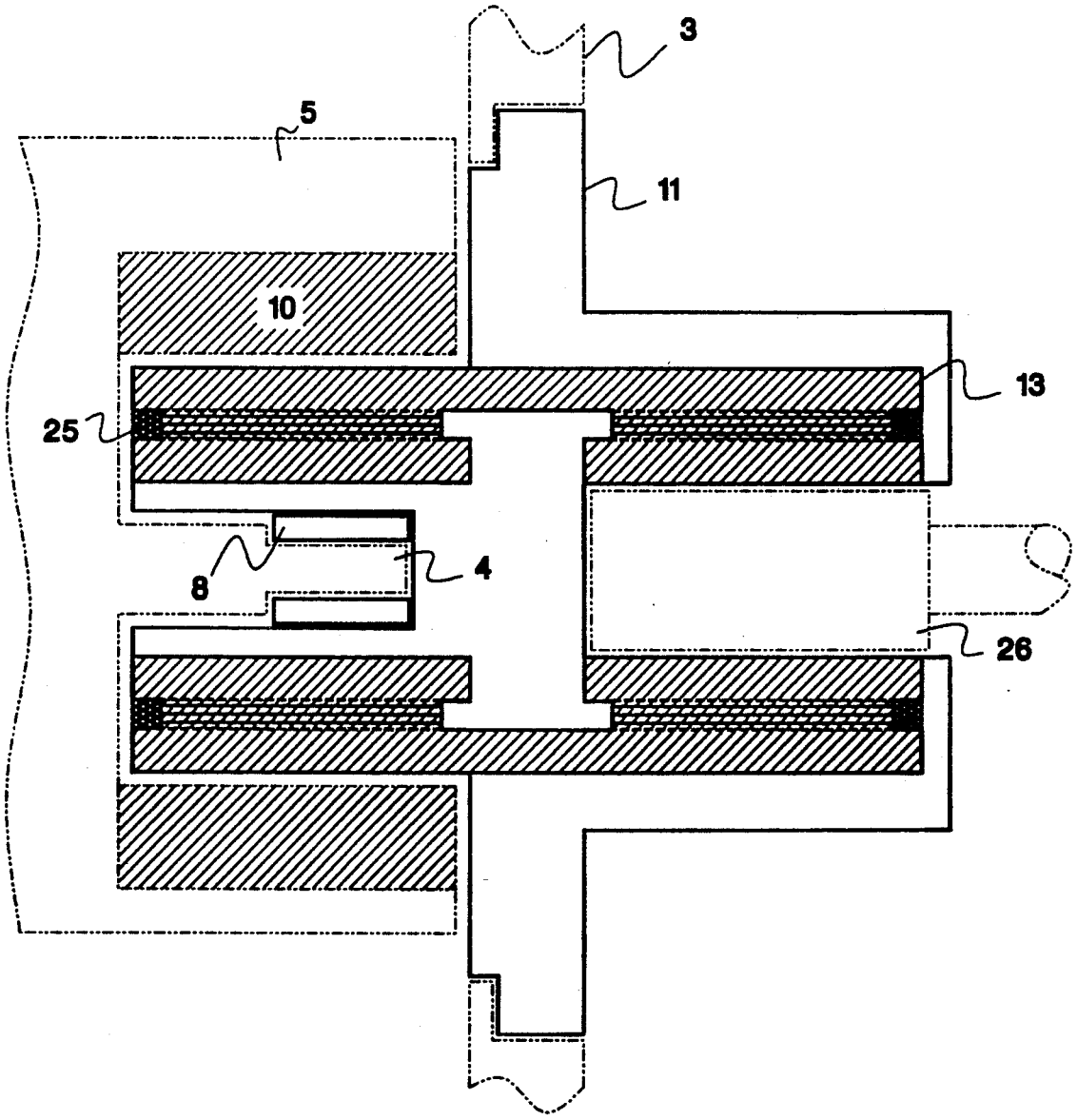
FIG. 6 is a side view illustrating a crankcase endplate configured for tractive power shaft output.

FIG. 6 is a side view of a crankcase endplate 11 showing the relative disposition of the major components of the electric transmission. The stator 13 and windings 25 have an alternating energy field induced in them by the internal rotor 10 housed in the crankshaft eccentric 5. Said energy is communicated through the stator 10 via an alternating magnetic field which induces a rotating, repulsive electric field in the output shaft rotor 26, causing said rotor and the shaft to which it is affixed, to rotate and transmit force to a load. The endplate 11 fits up to the crankcase 3, and supports the engine crankshaft 4 at the annular bearing 8.

I claim:

1. A radial, hot-gas engine of the stirling cycle class, comprised of a plurality of working cylinders of even number, said cylinders being disposed on perpendicular planes around the perimeters of a multiplicity of crankcase sections in the manner of a radial arc, half of said cylinders comprising hot-side heat exchangers fitted with heating means, and the remaining half comprising cold-side heat exchangers fitted with cooling means, each hot-side cylinder connected via a connecting means and regenerator apparatus through which a working fluid can pass, to a cold-side cylinder located ninety degrees around the perimeter of the crankcase from said hot-side cylinder, each pair of hot and cold cylinders so connected comprising a working pair, each of said cylinders housing a close fitting, sliding piston, said piston being fitted with sealing means, and with a roller-follower bearing assembly at the base; and passing through the central axis of the aforementioned crankcase, a crankshaft to which is affixed a multiplicity of eccentrics, said crankshaft being supported at multiple points by bearings which fit around the crankshaft, said bearings in turn being supported on their outside diameter by bearing support plates which are disposed at multiple points along the length of the sectional crankcase, between said crankcase sections and at the terminus ends of the consolidated crankcase; a pressure pump assembly comprised of a similarly designed crankcase, piston and cylinder arrangement, said pump piston being driven by one of the aforementioned eccentrics, the working fluid passages of said pump being connected to the engine crankcase and working cylinders via a connecting means which permits the pumping of a working fluid from the crankcase reservoir into the working cylinders of the engine, and its return from the working cylinders to the crankcase reservoir; a multiplicity of valves, said valves constituting the means by which the working fluid is controlled, and by which the internal working-fluid passages are isolated from the external environment, or connected to external charging and evacuation apparatus; filter apparatus and cooler apparatus which removes lubricant vapors from the working-fluid extracted from the crankcase; a cavity within the crankshaft eccentrics for housing electrical windings and pole-pieces, said windings and pole-pieces comprising the rotor of a combination electrical generator and starter motor; a fixed stator winding which is housed in the crankcase endplate, and disposed inside the aforementioned crankshaft rotor when the engine is assembled; an electric transmission which is housed in the crankcase endplate; and a cooler apparatus which cools the working fluid returned to the crankcase reservoir from the working cylinders.

* * * * *